US005391103A

United States Patent [19]

Mak

[11] Patent Number: 5,391,103

[45] Date of Patent: Feb. 21, 1995

[54] BUILDING BLOCK CONFIGURED FOR PLURAL CONNECTIONS

[76] Inventor: Dong K. Mak, 93 Banner Road, Nepan, Canada, K2H 9K9

[21] Appl. No.: 840,157

[22] Filed: Feb. 24, 1992

[51] Int. Cl.[6] ..... A63H 33/08

[52] U.S. Cl. ..... 446/125; 446/124

[58] Field of Search ..... 446/125, 124, 128, 120, 446/121, 85

[56] References Cited

U.S. PATENT DOCUMENTS 3,449,857 6/1969 De Christopher ..... 446/124
3,838,535 10/1974 Larws ..... 446/124
3,862,512 1/1975 Vogel ..... 446/128

FOREIGN PATENT DOCUMENTS 1659245 10/1969 Germany ..... 446/124
2161913 6/1973 Germany ..... 446/124

*Primary Examiner*—Mickey Yu

[57] ABSTRACT

A rectangular building block is provided with an upper and lower surface. The block has a pre-determined thickness, b, width, 2*b*, and length, 4*b*. The upper surface of the block has a first central symmetrical channel with length 2*b* and rectangular cross-section with width 2*b* and depth *b*/2, intersecting at a right angle 2 and on top of a second central symmetrical channel on the lower surface with length 4*b* and rectangular cross section with width b and depth *b*/2. The building block allows for numerous interactions which enables the creation of a large variety of structures.

3 Claims, 6 Drawing Sheets

BUILDING BLOCK CONFIGURED FOR PLURAL CONNECTIONS

REFERENCES CITED

| U.S. PATENT DOCUMENTS | | | |
|---|---|---|---|
| 1,894,605 | 1/1933 | Wright | 46/25 |
| 3,449,857 | 6/1969 | DeChristopher | 46/25 |
| 3,678,613 | 6/1972 | Geymeier | 46/25 |
| 3,822,569 | 7/1974 | Lautrup-Larsen | 46/24 |
| 3,838,535 | 10/1974 | Larws | 446/124 |
| 4,376,351 | 3/1983 | Larws | 446/124 |
| 4,381,619 | 3/1983 | Griffin | 46/25 |
| 4,582,496 | 4/1986 | Larws | 446/104 |
| 4,740,188 | 4/1988 | Coster | 446/114 |
| 4,813,904 | 3/1989 | Larws | 446/118 |

This invention relates to building blocks, and, more particularly, to building bricks which are particularly well adapted for use as toy building blocks.

Many different types of building blocks are known, from which objects can be constructed by fitting them together. The method of building with some of the known blocks, however, requires a plurality of complicated connecting elements. Other methods assume the design of a building element such that it can interfit with identical building elements, thus eliminating connecting elements. However, they are either not aesthetically appealing, or they can interfit together only in a few fashions.

It is an object of the present invention to provide a novel building block, which fulfills the following conditions:

1. The blocks are easy to be constructed and easy to assemble.

2. Each block consists of several male mating parts and several female mating parts.

3. Two identical blocks can interfit tightly with each other in many distinct fashions.

4. A female mating part of a building block can fit tightly with male mating parts from one, two, or three identical building blocks.

Thus, a plurality of elements of the present invention can interfit together in many more distinct fashions than those described in the prior art.

SUMMARY OF THE INVENTION

In accordance with the invention, a rectangular building block with an upper and lower surface is provided. The block has a predetermined thickness, b, width, $2b$, and length, $4b$, the upper surface with a first central symmetrical channel with length $2b$ and rectangular cross-section with width $2b$ and depth $b/2$, intersecting at a right angle and on top of a second central symmetrical channel on the lower surface, with length $4b$ and rectangular cross section with width b and depth $b/2$.

In another aspect of the invention, a rectangular building block is provided with an upper surface with n first channels, where n is a whole number, and a lower surface with m second channels, where m is a whole number, the block having:

a) a pre-determined thickness, b;

b) a length $4nb$;

c) a width $2mb$;

where said first channels are perpendicular to the length of the block, with length $2mb$ and rectangular cross-section with width $2b$ and depth $b/2$ and where said second channels are perpendicular to the width of the block, with length $4nb$ and rectangular cross-section with width b and depth $b/2$.

A still further form of the invention provides a building block comprising:

a) two east-west parallel bars of rectangular cross-section with length $4b+2p$, width $b/2$ and thickness $b/2$, where b and p are predetermined lengths;

b) two north-south parallel bars of rectangular cross-section with length $2b+2q$, width b and thickness $b/2$, where q is a pre-determined length, the north-south parallel bars intersecting the east-west parallel bars at right angles and connected to the east-west parallel bars by c) four vertical parallel bars of rectangular cross-section with length r, width b and thickness $b/2$, where r is a predetermined length, each vertical parallel bar at right angles between the east-west and north-south parallel bars in order tha a p length of each east-west parallel bar protrudes outwardly from each north-south parallel bar and a q length of each north-south parallel bar protrudes outwardly from each east-west parallel bar.

For a better understanding of the invention, reference may be had to the following detailed description taken in connection with the accompanying drawing in which:

FIG. 1 is a perspective view of the building block;

FIG. 2(*a*)–(*d*) show the different views of the building block. FIG. 2(*a*) shows the top plan view. FIG. 2(*b*) and FIG. 2(*c*) show the two side views. FIG. 2(*d*) shows the bottom plan view.

Figure 7A:
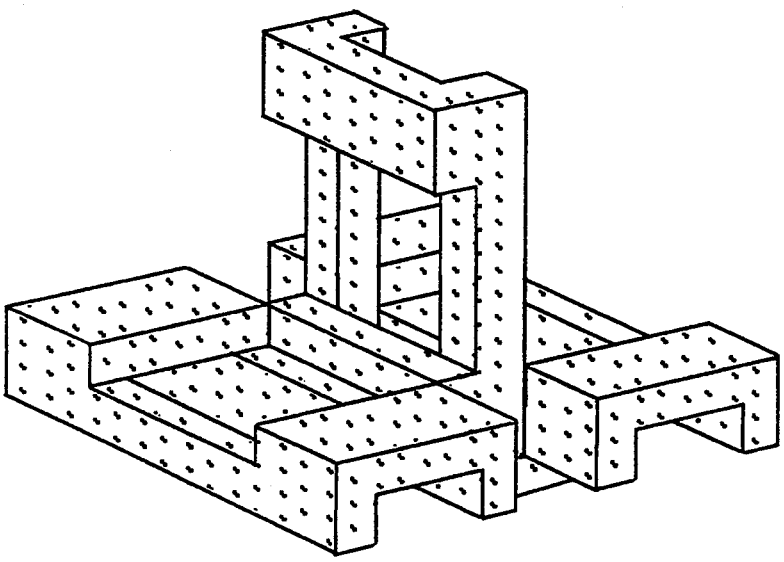
Figure 7B:
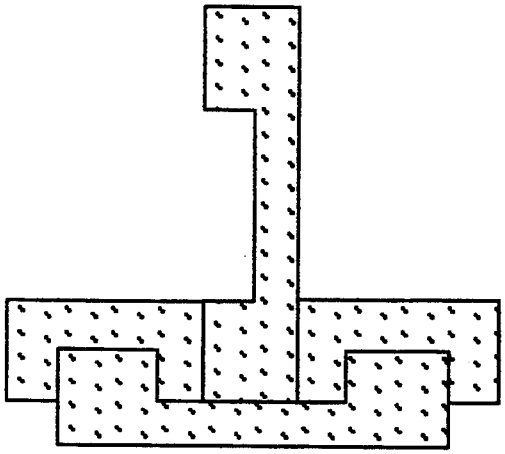

FIG. 7(*a*)–(*b*) show one possibility of how the male mating parts of three building blocks interfitted into one female mating part of a fourth building block. FIG. 7(*a*) shows a perspective view and FIG. 7(*b*) shows a side view.

Figure 8A:
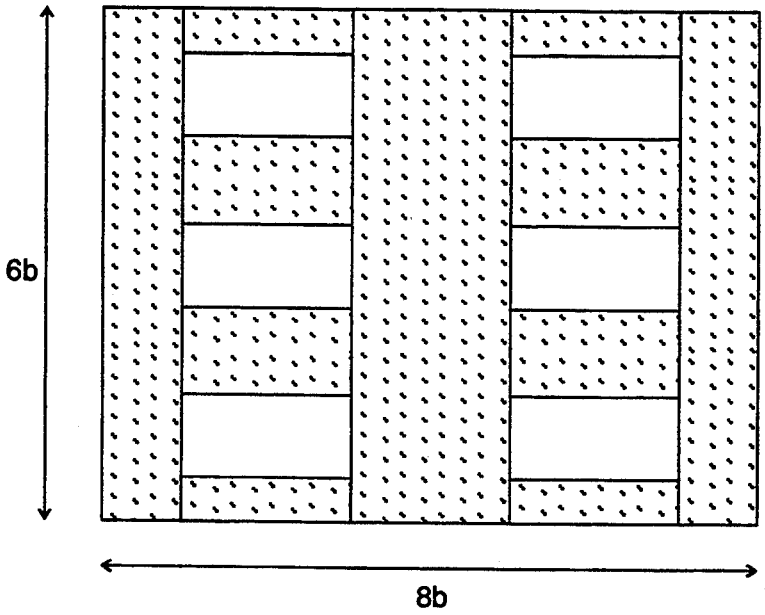
Figure 8B:
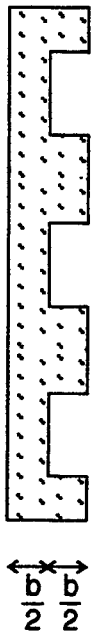
Figure 8C:
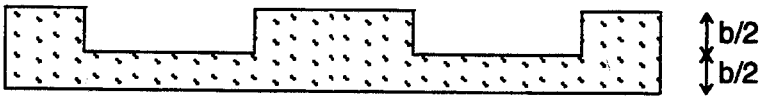

FIG. 8(*a*)–(*c*) show the different views of an extended building block. FIG. 8(*a*) shows the top plan view. FIG. 8(*b*) and FIG. 8(*c*) show the two side views.

Figure 9A:
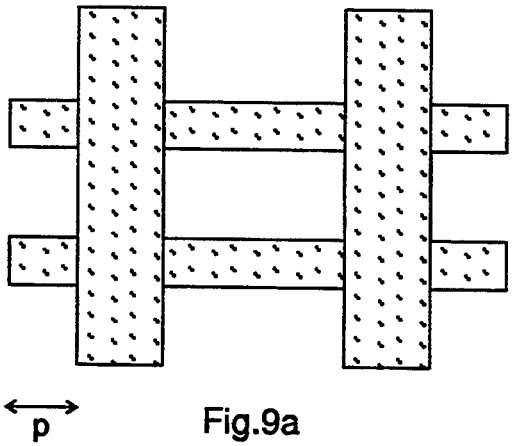
Figure 9B:
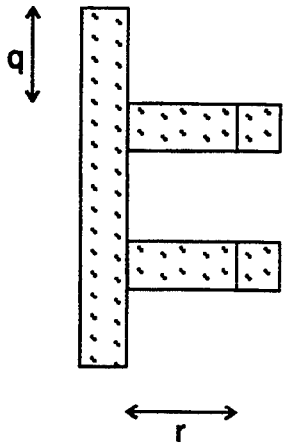
Figure 9C:
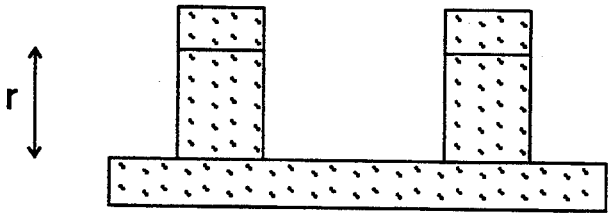

FIG. 9(*a*)–(*c*) show the different views of a generalized building block. FIG. 9(*a*) shows the top plan view. FIG. 9(*b*) and FIG. 9(*c*) show the two side views.

Figure 1:
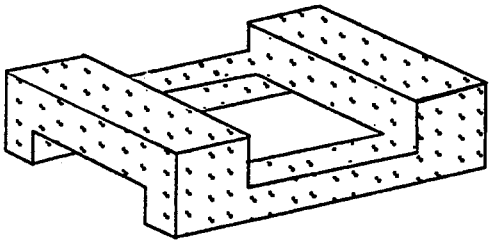
Figure 2A:
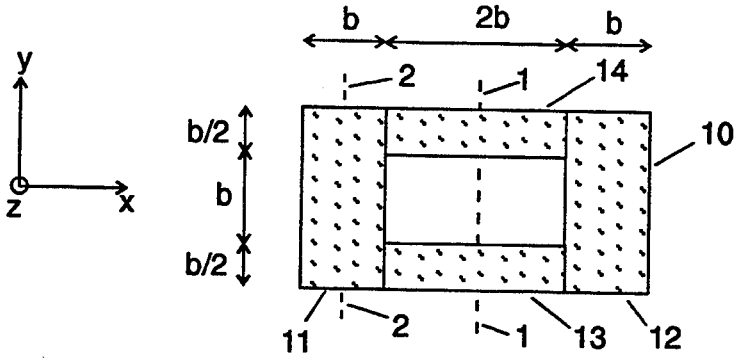
Figure 2B:
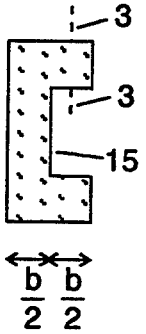
Figure 2C:
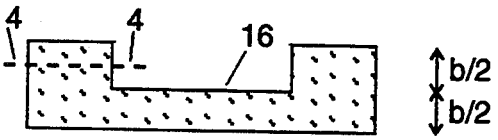
Figure 2D:
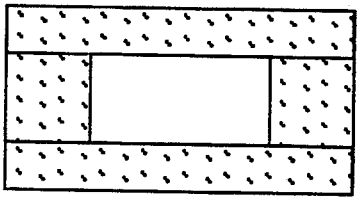

Referring now more in detail to the drawing, there is shown in FIG. 1 a perspective view of a basic building block of the invention. It can be considered as two parallel rectangular bars mounted perpendicularly on top of two other parallel rectangular bars. It can also be considered as a rectangular brick with two central channels of rectangular cross-sectional shape stacked together in a cross shape. Also, looking from the side perspective, the four side views display 4 U's, two of which are inverted with respect to the other two.

FIG. 2(*a*)–(*d*) show the top, side and bottom views of the building block 10. The rectangular coordinate system, xyz, corresponds to the top plan view, with the z axis pointing out of the paper. The rectangular block has a length of 4b, b being any arbitrary length unit; a width of 2b and a thickness of b. The block comprises of two parallel rectangular bars 11 and 12, of dimension $b \times 2b \times b/2$, attached perpendicularly onto two other parallel rectangular bars 13 and 14 of dimension $4b \times b/2 \times b/2$. The block thus comprises of two channels of rectangular cross-sections :- the bottom channel 15 has dimension of $4b \times b \times b/2$ and the top channel 16 has a dimension of $2b \times 2b \times b/2$.

Looking in different directions, the block can be considered to comprise of five female mating parts:

(1) $b \times b/2$ with a depth of 4b (looking in the x direction) (FIG. 2(*b*))

(2) $2b \times b/2$ with a depth of 2b (looking in the y direction) (FIG. 2(*c*))

(3) $2b \times 2b$ with a depth of $b/2$ (looking in the -z direction) (FIG. 2(*a*))

(4) $2b \times b$ with a depth of $b/2$ (looking in the -z direction) (FIG. 2(*a*))

(5) $4b \times b$ with a depth of $b/2$ (looking in the z direction) (FIG. 2(*d*))

Furthermore, the block can be considered to comprise of eight male mating parts of dimensions:

(1) $2b \times b$ with a-depth of 4b (FIG. 2(*b*))

(2) $4b \times b$ with a depth of 2b (FIG. 2(*c*))

(3) $2b \times 2b$ with a depth of $b/2$ (FIG. 2(*a*))

(4) $4b \times 2b$ with a depth of $b/2$ (FIG. 2(*a*))

(5) $2b \times b/2$ with a depth of 2b (transverse sectional view taken along the line 1—1 of FIG. 2(*a*))

(6) $2b \times b/2$ with a depth of 2b (transverse sectional view taken along the line 2—2 of bar 11 of FIG. 2(*a*))

(7) $b/2 \times b/2$ with a depth of 4b (transverse sectional view taken along the line 3—3 of FIG. 2(*b*))

(8) $b \times b/2$ with a depth of 2b (transverse sectional view taken along the line 4—4 of FIG. 2(*c*))

Each male mating part can fit into one or more than one female mating parts, thus permitting many possible combinations.

Figure 3:
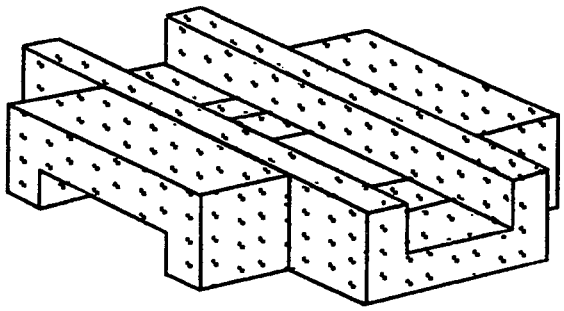
FIG. 3 shows a configuration where two building blocks interfit together to form a flat cross.

FIG. 3 shows one of the many possibilities that two blocks can interfit together tightly. The male mating part (3) of the top block fits into female mating part (3) of the bottom block.

Figure 4:
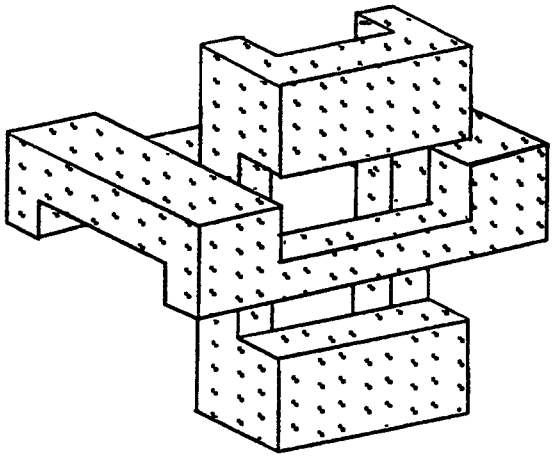
FIG. 4 shows a configuration with one building block being inserted into the center hole of the other.

FIG. 4 shows another possibility where two blocks fit together. The male mating part (5) of the vertical block fits into the female mating part (4) of the other block.

Figure 5:
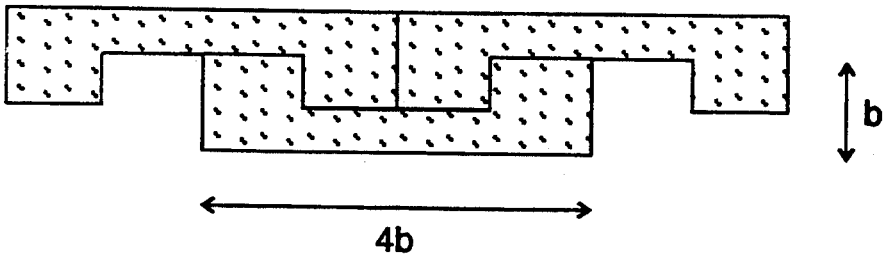
FIG. 5 shows the male mating parts of two building blocks interfit into the wider central channel of a third building block.

FIG. 5 shows how the male mating parts of two blocks interfit into one female mating part of a third block. The male mating parts (8) of the two blocks fit into the female mating part (2) of the third block.

Figure 6:
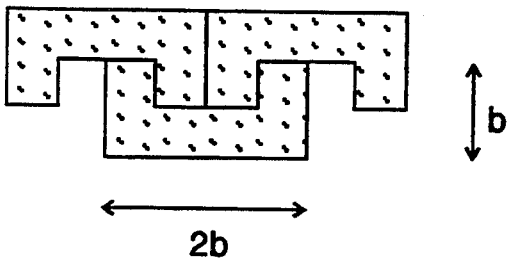
FIG. 6 shows other male mating parts of two building blocks interfit into the shorter central channel of a third building block.

FIG. 6 shows another possibility where the male mating parts of two blocks interfit into a female mating part of a third block. The male mating parts (7) of the two blocks fit into the female mating part (1) of the third block.

FIG. 7(*a*)-(*b*) show one of the possibilities of how the male mating parts of three building blocks can interfit into a female mating part of a fourth building block. The male mating parts (7) of two building blocks and the male mating part (2) of a third building block fit into the female mating part (3) of the fourth building block. FIG. 7(*a*) and (*b*) show the perspective and side view respectively.

The basic building block can be extended in the x and y direction. With n channels in the y direction, the length (in x direction) of the extended block is equal to 4nb. With m channels in the x direction, the width (in y direction) of the extended block is equal to 2mb. For the basic building block, $n=m=1$, thus its length and width are 4b and 2b respectively. FIG. 8(*a*)-(*c*) show the top view and two side views of an extended block with $n=2$ and $m=3$.

The basic building block can be modified such that the parallel bars protrude outwards from the rectangular brick. Let p be the extended length in the x direction on either side and q be the extended width in the y direction on either side. The height of the basic building block can be extended by connecting two parallel bars in the x direction to the two parallel bars in the y direction with four parallel vertical bars of length r in the z-direction. FIG. 9(*a*)-(*c*) show the top plan view and two side views of the generalized building block. In the basic building block, $p=q=r=0$.

The buildings blocks have to be fabricated from a material having sufficient resilience to enable the male mating part(s) of one block to interfit tightly into the female mating part of another block, and to enable the blocks to be detached quite easily. A suitable resilient material for the blocks is a synthetic plastics material such as ABS. The blocks may be prepared in a variety of colors in order to emphasize a particular part of a configuration being built, as well as to add visual appeal when used as toys.

From the foregoing, it will be seen that the present invention affords a set of novel building blocks with flexibility and the possibilities for variations, as well as different levels of play.

Although the invention has been described in considerable detail with reference to certain preferred embodiments thereof, it will be understood that variations and modifications can be effected within the spirit and scope of the invention as described above.

I claim:

1. A rectangular building block with an upper and lower surface, said block with a pre-determined thickness, b, width, 2b, and length, 4b, the upper surface with a first central symmetrical channel with length 2b and rectangular cross-section with width 2b and depth $b/2$, intersecting at a right angle and on top of a second central symmetrical channel on the lower surface, with length 4b and rectangular cross section with width b and depth $b/2$.

2. A rectangular building block with an upper surface with n first channels, where n is a whole number, and a lower surface with m second channels, where m is a whole number, the block having:

a) a pre-determined thickness, b;

b) a length 4nb;

c) a width 2mb;

where said first channels are perpendicular to the length of the block, with length 2mb and rectangular cross-section with width 2b and depth $b/2$ and where said second channels are perpendicular to the width of the block, with length 4nb and rectangular cross-section with width b and depth $b/2$.

3. A building block comprising:

a) two east-west parallel bars of rectangular cross-section with length $4b+2p$, width $b/2$ and thickness $b/2$, where b and p are predetermined lengths;

b) two north-south parallel bars of rectangular cross-section with length $2b+2q$, width b and thickness $b/2$, where q is a pre-determined length, the north-south parallel bars intersecting the east-west parallel bars at right angles and connected to the east-west parallel bars by;

c) four vertical parallel bars of rectangular cross-section with length r, width b and thickness $b/2$, where r is a predetermined length, each vertical parallel bar at right angles between the east-west and north-south parallel bars in order that a p length of each east-west parallel bar protrudes outwardly from each north-south parallel bar and a q length of each north-south parallel bar protrudes outwardly from each east-west parallel bar.

* * * * *